US010443427B2

(12) United States Patent
Mongis et al.

(10) Patent No.: US 10,443,427 B2
(45) Date of Patent: Oct. 15, 2019

(54) METHOD FOR CREATING AND REPAIRING A TURBOMACHINE COMPONENT AND ASSOCIATED TURBOMACHINE COMPONENT

(71) Applicant: SAFRAN AIRCRAFT ENGINES, Paris (FR)

(72) Inventors: Thomas Guillaume Mongis, Moissy-Cramayel (FR); Guillame Benoit Noel Champion, Moissy-Cramayel (FR); Pascal Jean-Serge Drouard, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 293 days.

(21) Appl. No.: 15/320,708

(22) PCT Filed: Jun. 15, 2015

(86) PCT No.: PCT/FR2015/051582
§ 371 (c)(1),
(2) Date: Dec. 20, 2016

(87) PCT Pub. No.: WO2015/197942
PCT Pub. Date: Dec. 30, 2015

(65) Prior Publication Data

US 2017/0145849 A1 May 25, 2017

(30) Foreign Application Priority Data

Jun. 23, 2014 (FR) ..... 14 55759

(51) Int. Cl.
*F01D 11/12* (2006.01)
*F01D 9/04* (2006.01)
(Continued)

(52) U.S. Cl.
CPC ..... *F01D 11/122* (2013.01); *F01D 9/041* (2013.01); *F01D 11/001* (2013.01);
(Continued)

(58) Field of Classification Search
CPC .... F01D 11/122; F01D 11/001; F01D 21/003; F01D 9/041; F04D 29/164; F04D 29/542;
(Continued)

(56) References Cited

U.S. PATENT DOCUMENTS

2007/0231127 A1* 10/2007 Durand ..... F01D 11/122 415/173.1
2008/0240915 A1* 10/2008 Castel ..... F01D 9/04 415/208.2

(Continued)

FOREIGN PATENT DOCUMENTS

DE 10259963 A1 7/2004
EP 1985807 A2 10/2008
EP 2372101 A2 10/2011

OTHER PUBLICATIONS

International Search Report with English Language Translation dated Sep. 15, 2015, PCT Application No. PCT/FR2015/051582.

*Primary Examiner* — Joseph J Dallo
(74) *Attorney, Agent, or Firm* — Womble Bond Dickinson (US) LLP

(57) ABSTRACT

Method for repairing a turbine-engine component, such as a turbine nozzle (D), this component comprising an annular wall for supporting an abradable ring (C2), the method comprising first-repair steps (I) consisting in: removing a first abradable ring (C2), the brazing for fixing the ring to the annular wall, and an inner peripheral part of the annular wall, and fixing a second abradable ring (C2) to the annular wall by brazing, characterized in that the second abradable ring has finished dimensions (r1'), the first repair not having
(Continued)

a step of grinding of the second ring after fixing thereof to the annular wall.

13 Claims, 3 Drawing Sheets

(51) Int. Cl.

| | |
|---|---|
| ***F01D 11/00*** | (2006.01) |
| ***F01D 21/00*** | (2006.01) |
| ***F04D 29/54*** | (2006.01) |
| ***F04D 29/64*** | (2006.01) |
| ***F04D 29/16*** | (2006.01) |

(52) U.S. Cl.
CPC ..... *F01D 21/003* (2013.01); *F04D 29/164* (2013.01); *F04D 29/542* (2013.01); *F04D 29/644* (2013.01); *F05D 2220/30* (2013.01); *F05D 2230/237* (2013.01); *F05D 2230/238* (2013.01); *F05D 2230/644* (2013.01); *F05D 2230/80* (2013.01)

(58) Field of Classification Search
CPC ..... F04D 29/644; F05D 2220/30; F05D 2230/238; F05D 2230/80; F05D 2230/237; F05D 2230/644
See application file for complete search history.

(56) References Cited

U.S. PATENT DOCUMENTS

| | | | | |
|---|---|---|---|---|
| 2008/0260522 | A1* | 10/2008 | Alvanos | F01D 11/001 415/173.4 |
| 2009/0041610 | A1* | 2/2009 | Meier | F01D 11/127 419/26 |
| 2011/0241295 | A1* | 10/2011 | Voisine | F01D 11/001 277/500 |
| 2013/0177410 | A1* | 7/2013 | Eleftheriou | F01D 25/24 415/208.1 |
| 2015/0118035 | A1* | 4/2015 | Gendraud | F01D 9/041 415/191 |

* cited by examiner

METHOD FOR CREATING AND REPAIRING A TURBOMACHINE COMPONENT AND ASSOCIATED TURBOMACHINE COMPONENT

TECHNICAL FIELD

The present invention relates to a method for producing and repairing a turbine-engine component, such as a turbine nozzle or a stator annulus.

PRIOR ART

The prior art comprises in particular the documents EP-A2-2 372 101, EP-A2-1 985 807 and DE-A1-102 59 963.

As is known, a turbine nozzle, for example a low-pressure nozzle, comprises an annular row of vanes extending between an inner annular platform and an outer annular platform. The nozzle forms part of the turbine stator and is interposed between two rotor wheels.

The outer annular platform of the nozzle comprises means for attachment to a turbine casing and its inner annular platform comprises a cylindrical annular wall for fixing a ring made from abradable material. This ring is for example of the honeycomb type and is intended to cooperate by friction with radially outer annular wipers of the turbine rotor, in order to limit leakages of air between the nozzle and the rotor.

In the prior art, the abradable ring is fixed to the cylindrical wall by brazing.

In the event of significant wear to the abradable ring, it is necessary to replace it during a repair operation. The abradable ring is removed by machining. Before fixing a new abradable ring, it is necessary to remove all the brazing fixing the worn ring. In practice, to remove the ring and its fixing brazing it is necessary to machine a little into the cylindrical wall and therefore to remove an internal peripheral part of the cylindrical wall. The quantity of material thus removed in the cylindrical wall is not controlled.

In the prior art, in order to compensate for this reduction in thickness of the cylindrical wall, an oversized abradable ring is attached to the cylindrical wall in the radial direction. After it is fixed to this cylindrical wall by brazing, the ring undergoes a grinding operation by machining in order to give it the correct dimensions.

In the case in which a nozzle undergoes a second repair operation consisting of once again replacing its worn abradable ring with a new one, it will be understood that the removal of the ring and brazing by machining will cause an additional reduction in the thickness of the cylindrical wall. In other words, the thickness of the cylindrical wall decreases with each repair operation. The new abradable ring is oversized in thickness in order to compensate for the reduction in thickness of the cylindrical wall.

Currently, only one standard reference for an oversized abradable ring is used for manufacturing or repair to a nozzle and, in each case (manufacture or repairs), the ring is ground after it is fixed in order to give it the correct dimensions.

However, this technology has numerous drawbacks in particular related to the grinding step. This grinding step give rise to a significant period of immobilisation of the turbine engine and needs specific installation and tooling that are relatively expensive, in particular because the equipment must reproduce the positioning of the nozzle relative to the rotor.

The problem is also posed in the case of a stator annulus. This annulus comprises means for attachment to a stator casing and surrounds a rotor wheel. It has an annular wall supporting an abradable ring that is intended to cooperate by friction with radially outer annular wipers of the rotor wheel, in order to limit leakages of air between the casing and the rotor. As in the aforementioned case, the abradable ring is fixed by brazing to the annular wall of the annulus, and must be ground. In the case of wear it is removed by machining with a view to replacement thereof.

The invention proposes a solution to the aforementioned problem that is simple, effective and economical.

DISCLOSURE OF THE INVENTION

The invention proposes a method for producing a turbine-engine component, such as a turbine nozzle, this component comprising an annular wall for supporting an abradable ring, the method comprising a step of fixing the abradable ring to the annular wall by brazing, characterised in that the abradable ring has finished dimensions, the method not having a step of grinding the ring after fixing thereof to the annular wall.

The method thus differs from the prior art in particular in that it does not comprise a step of grinding the ring, subsequent to the fixing thereof to the annular wall. This is made possible by the fact that the abradable ring already has the finished dimensions before fixing thereof. The invention is thus particularly advantageous since it makes it possible to eliminate the grinding step from the prior art, which is lengthy, expensive and complex to implement.

The invention further proposes a method for repairing a turbine-engine component, such as a turbine nozzle, this component comprising an annular wall supporting an abradable ring, the method comprising first-repair steps consisting of:

a) removing a first abradable ring, the brazing for fixing the ring to the annular wall, and an inner peripheral part of the annular wall, and b) fixing a second abradable ring to the annular wall by brazing, characterised in that the second abradable ring has the finished dimensions, the first repair not having a step of grinding of the second ring after fixing thereof to the annular wall.

Step a) can be carried out by machining. Advantageously, the annular wall of the nozzle is machined so that it has a predetermined radial dimension, referred to as the reference dimension.

The repair method may comprise one or more of the following features or steps, which can be taken in isolation from one another or in combination with one another:

step a) is carried out by machining;

an inner peripheral part of the annular wall is removed at step a), until the annular wall has a predetermined radial dimension;

the method comprises second-repair steps consisting in:

c) removing the second abradable ring, the brazing for fixing this second ring, and an inner peripheral part of the annular wall, d) fixing a plate to the inner periphery of the annular wall by brazing, and e) fixing a third abradable ring with finished dimensions to the plate by brazing, the third abradable ring having a radial thickness that is different from that of the second ring and is determined according to the thickness of the plate and the thickness of material removed from the annular wall;

the plate is a metal sheet, which has for example a thickness of 1 mm;

the plate and the third ring are brazed at the same time;

the method comprises third-repair steps consisting in:

f) removing the third abradable ring, the brazing for fixing this third ring, and an inner peripheral part of the plate, and g) fixing a fourth abradable ring with finished dimensions to the plate by brazing;

step f) can be carried out by machining; advantageously, the plate of the nozzle is machined so that it has a predetermined radial dimension, referred to as the reference dimension;

the plate has a predetermined radial dimension at the end of step f), and the fourth ring has a radial thickness identical to that of the second ring;

the plate and/or the abradable ring may be divided into sectors and each comprise an annular row of sectors disposed circumferentially end to end;

the method comprises a step of marking the nozzle after the or each repair; this marking step is particularly advantageous since it enables a maintenance operator for example to quickly ascertain whether the component has already been repaired and, if so, how many repairs it has undergone.

The present invention also relates to a turbine-engine component, comprising an annular wall supporting an abradable ring, characterised in that it comprises at least one marking identifying one or more repairs to the component by replacement of the ring.

The abradable ring may be fixed by brazing to a plate, which is itself fixed by brazing to the annular wall.

The plate and/or the abradable ring may be divided into sectors.

This component may be a turbine nozzle or a stator annulus.

DESCRIPTION OF THE FIGURES

The invention will be better understood and other details, features and advantages of the invention will become clear upon reading the following description given by way of non-limitative example and with reference to the accompanying drawings, in which.

DETAILED DESCRIPTION

Figure 1:
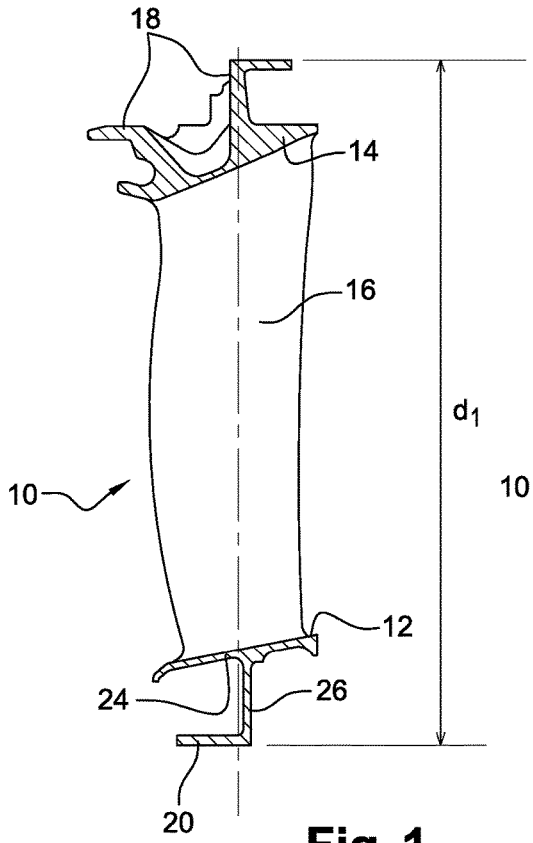
FIGS. 1 and 2 are schematic half-views in axial section of a turbine nozzle, both with and without the abradable ring, and illustrate steps of a production method according to the invention.
Figure 2:
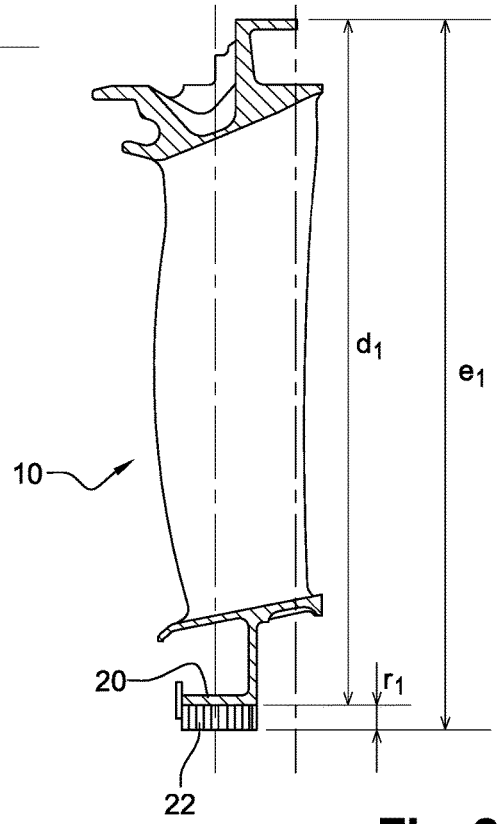

Reference is made first of all to FIGS. 1 and 2, which illustrate an embodiment of the method according to the invention for producing a turbine-engine component, which is here a turbine nozzle 10, and more precisely a low-pressure turbine nozzle.

The nozzle 10 comprises two annular platforms, respectively inner 12 and outer 14, which are coaxial and extend one inside the other. The platforms 12, 14 are connected together by an annular row of substantially radial vanes 16.

The outer platform 14 comprises means 18 for attachment to a stator casing (not shown).

The inner platform 12 comprises an annular wall 20, which is cylindrical in this case, supporting an abradable ring 22, for example of the honeycomb type. The annular wall 20 extends coaxially with and inside another annular wall 24 of the platform 12, and is connected to this other annular wall 24 by a substantially radial wall 26. The outer annular surface of the wall 24 internally defines the flow duct for the airflow in the turbine.

The abradable ring 22 is preferably divided into sectors.

The abradable ring 22 is fixed to the radially inner surface of the annular wall 20 by brazing, for example by means of a brazing strip interposed between the wall and the ring.

In accordance with the invention, the abradable ring 22 has the finished dimensions before fixing thereof by brazing, so as to eliminate any operation for grinding the ring subsequently to the fixing thereof.

In the example shown, the ring 22 has a radial thickness r1 and the radial dimension of the nozzle, measured between the radially inner and outer ends of the nozzle (here between the radially inner end of the ring 22 and the radially outer end of the attachment means 18), is denoted e1.

r1=e1−d1, d1 being the radial dimension of the nozzle without the ring 22 (FIG. 1), that is to say the radial distance between the radially inner end of the annular wall 20 and the radially outer end of the attachment means 18.

The value of r1 can thus easily be deduced from the values of d1 and e1. In other words, it is possible to deduce the radial thickness of the abradable ring 22 from the radial dimensions of the nozzle 10, both with and without the ring.

Reference is now made to FIGS. 3 to 5 and 7, which relate to a method according to the invention for repairing a turbine-engine component, which is here also a turbine nozzle 10.

Figure 6:
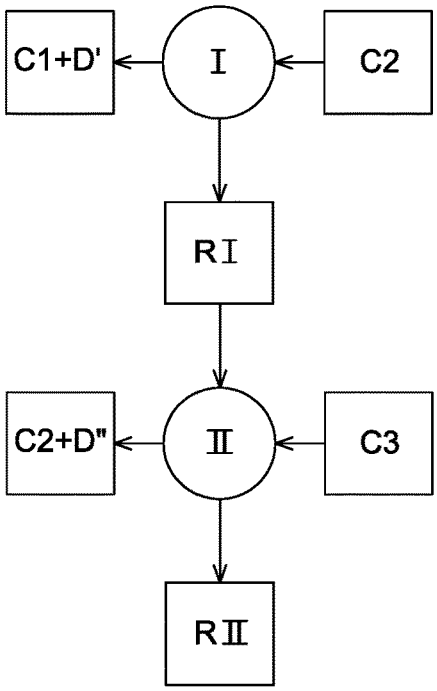
FIG. 6 is a flow diagram showing steps of a repair method according to the prior art.

In the prior art shown in FIG. 6, it can be seen that each step I and II for replacing a worn ring C1, C2 by a new ring C2, C3 is followed by a step RI and RII of grinding this new ring. Hereinafter, a ring is designated C, this letter being associated with a numeral that corresponds to the number of the ring. Thus C1 relates to the first ring or original ring of a nozzle, C2 relates to the second ring of a nozzle, that is to say the ring replacing the first ring (during a first repair or repair/replacement step), and so on.

The first repair operation I consists in removing the worn ring C1 by machining the ring and an inner peripheral part D' of the annular wall supporting this ring (the radial thickness of which decreases), and then fixing the new ring C2 by brazing.

This first repair operation I is followed by a step RI of grinding the ring C2 by machining.

In the case in which the second ring C2 is worn and must be replaced, a new repair operation is performed. The second repair operation II consists in removing the worn ring C2 by machining the ring and an inner peripheral part D" of the annular wall supporting this ring (the thickness of which decreases further), and then fixing the new ring C3 by brazing.

This second repair operation II is followed by step RII of grinding of the ring C3 by machining.

By contrast, according to the present invention, the repair method illustrated in FIGS. 3 to 5 and 7 does not include a ring-grinding step.

As described above with reference to FIGS. 1 and 2, the nozzle D is produced by attaching and fixing by brazing a first ring C1 to the aforementioned annular wall of the nozzle.

In the case in which this first ring C1 is worn and must be replaced, a first repair operation I is implemented. The first repair operation I consists in removing the worn ring C1 by machining the ring and an internal peripheral part D' of the annular wall supporting this ring (the thickness of which decreases), and then fixing the new ring C2 by brazing, for example by means of a brazing strip interposed between the ring C2 and the wall of the nozzle D.

Figure 3:
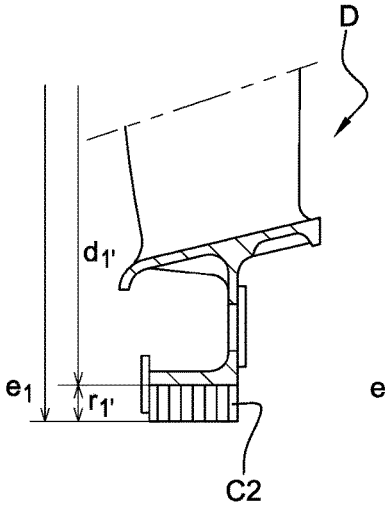
FIGS. 3 to 5 are partial schematic views of a turbine nozzle on a larger scale and illustrate steps of a repair method according to the invention.

This maintenance operation is advantageously followed by a step MI of marking the nozzle in order to be able to clearly identify that the nozzle D has been repaired once. The nozzle from FIG. 3 is then obtained.

According to the invention, the ring C2 has the finished dimensions and does not undergo any grinding after fixing thereof by brazing. The thickness of material D' that is removed from the annular wall of the nozzle is controlled here so that the radial thickness of the ring C2 makes up for this loss of thickness. It will thus be understood that the thickness of the ring C2 is greater than that of the ring C1 and that a radial increased material thickness is initially advantageously provided on the annular wall in order to allow the machining operation during the first repair operation I. In other words, with reference to FIGS. 2 and 3, r1'>r1 and r1'=e1−d1' and r1'−r1=d1−d1'.

d1' here represents the reference radial dimension of the nozzle without the ring.

In the case in which the second ring C2 is worn and must be replaced, a second repair operation II is implemented. The second repair operation II consists in removing the worn ring C2 by machining the ring and an inner peripheral part D" of the annular wall supporting this ring (the thickness of which decreases further), and then fixing the new ring C3 by brazing but by means of a sheet-metal plate P interposed between the ring C3 and the annular wall of the nozzle. For this purpose, a first brazing strip is interposed between the plate P and the annular wall and a second brazing strip is interposed between the ring C3 and the plate P. The plate P is preferably divided into sectors.

Figure 4:
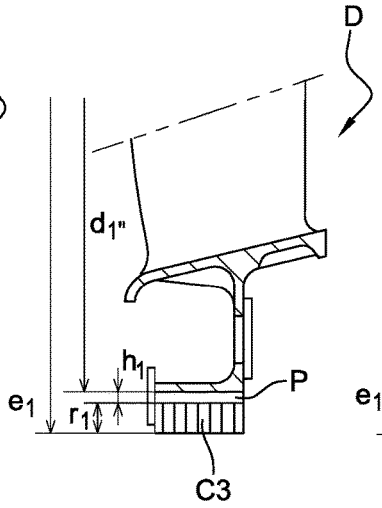

This maintenance operation II is advantageously followed by a step MII of marking the nozzle in order to be able to clearly identify that the nozzle D has been repaired twice. The nozzle of FIG. 4 is then obtained.

The ring C3 has the finished dimensions and does not undergo any grinding after fixing thereof by brazing. The thickness of material D" that is removed from the annular wall of the nozzle is here controlled so that the radial thickness r1 of the ring C2 and/or the thickness h1 of the plate P makes up for this loss of thickness. The thickness of C3 is less than that of C2 and may be identical to that of C1. The plate P has for example a thickness h1 of approximately 1 mm.

In the case in which the third ring C3 is worn and must be replaced, a third repair operation III is implemented. The third repair operation III consists in removing the worn ring C3 by machining the ring and an inner peripheral part P' of the plate P (the thickness of which decreases), and then fixing the new ring C4 to the plate P, by brazing, for example by means of a brazing strip interposed between the plate and the ring.

Figure 5:
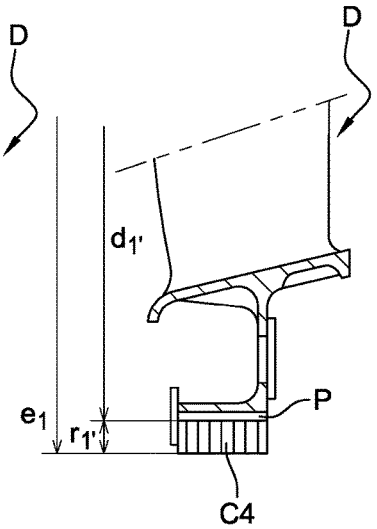

This maintenance operation III is advantageously followed by a step MIII of marking the nozzle in order to be able to clearly identify that the nozzle D has been repaired three times. The nozzle from FIG. 5 is then obtained.

The ring C4 has the finished dimensions and does not undergo any grinding after fixing thereof by brazing. The thickness of material P' that is removed from the plate P is controlled here in particular so that the radial dimension d1' of the nozzle without the ring C4 is equal to the aforementioned reference radial dimension (cf. FIG. 3). Use is therefore made of an abradable ring C4 of the same thickness r1' as during the first maintenance operation I (FIG. 3). It will thus be understood that C1 and C3 are identical (C1=C3) and that C2 and C4 are also identical (C2=C4). Just two abradable-ring references are therefore sufficient for implementing the method.

Figure 7:
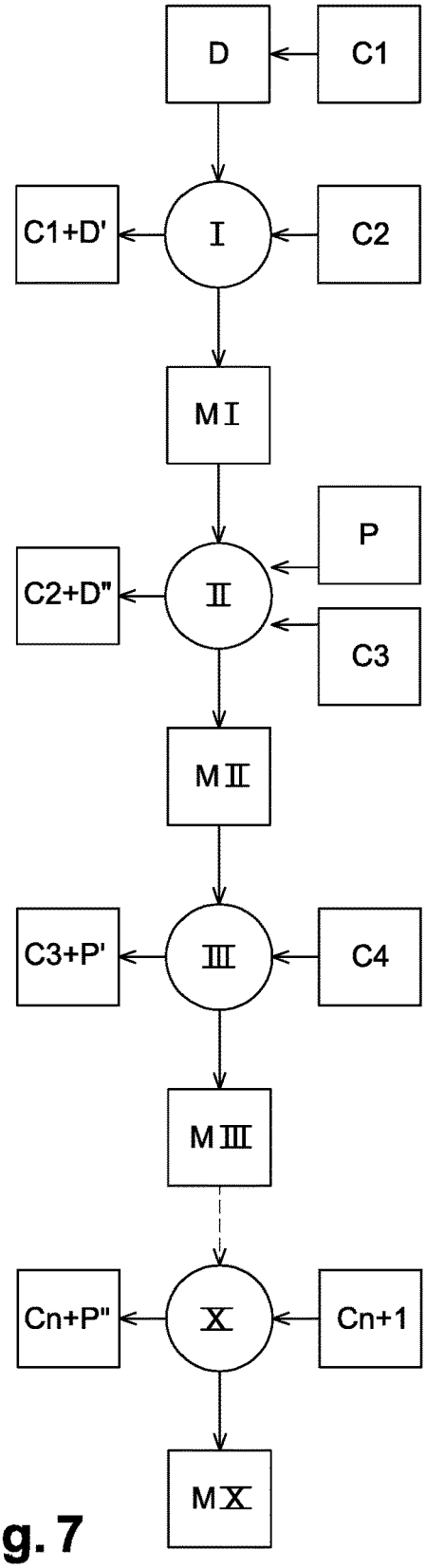
FIG. 7 is a flow diagram showing steps of a repair method according to the invention.

The number of repairs that a turbine nozzle can undergo may be limited to three. In a variant and as shown in FIG. 7, this number may be higher. For this purpose, it is preferable to provide a plate P of sufficient thickness to allow a plurality of successive repairs, each repair causing a reduction in thickness of this plate by removal of an additional inner peripheral part P". This avoids having to fix a new plate to the annular wall of the nozzle, although this can also be envisaged.

Figure 8:
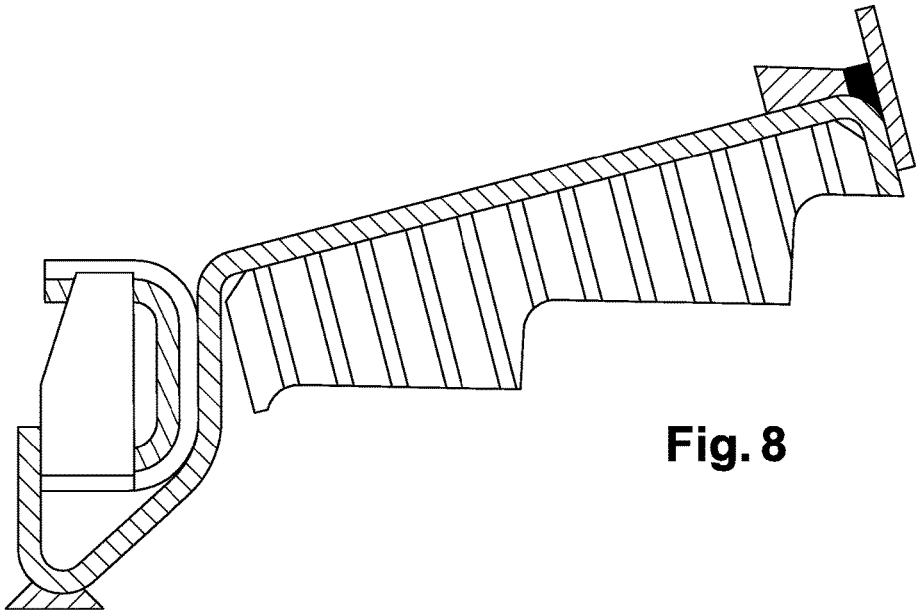
FIG. 8 is schematic half-view in axial section of a stator annulus.

The invention can be applied to a stator annulus 30 as shown in FIG. 8. The various steps shown in FIG. 7 are in particular directly applicable to this annulus, which can thus undergo a plurality of successive repair operations with a view to the replacement of its abradable ring.

Figure 9:
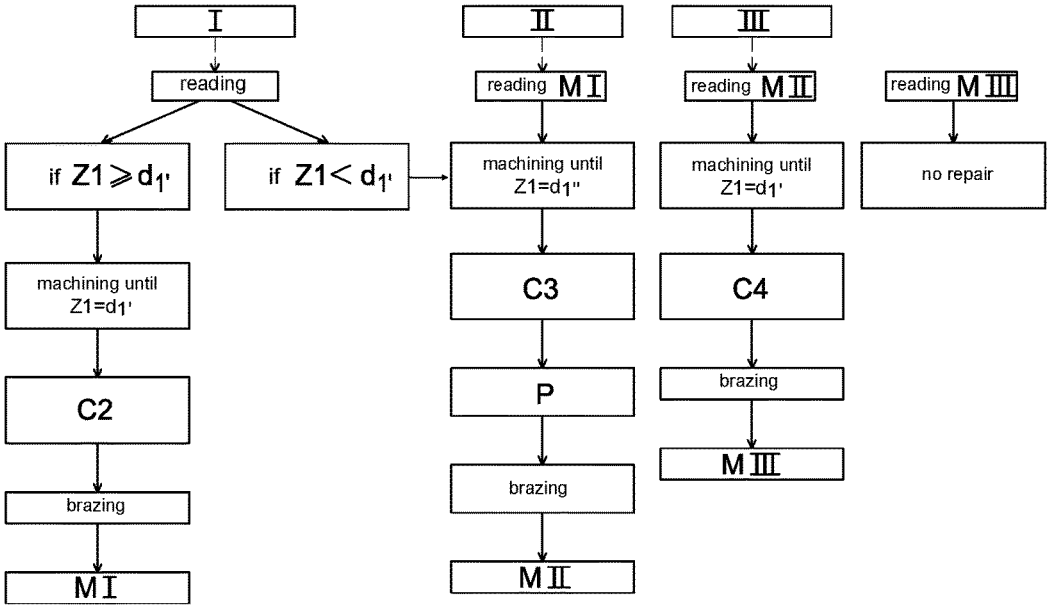
FIG. 9 is a flow diagram showing steps of a variant of a repair method according to the invention.

FIG. 9 shows a variant of a repair method according to the invention, which repeats the references I, II, III, C1, C2, etc. already used above.

It can here be noted that, at the start of each repair operation I, II, III, a step of reading and identifying any marking of the nozzle takes place. It may also be noted that, because of the thickness of the plate P used in the second repair step, the number of repairs that the nozzle can undergo is limited to three here.

Z1 is the value of the actual radial dimension of the nozzle after removal of the ring C1 and an inner peripheral part of its annular wall or of the plate. During the first repair I, the annular wall of the nozzle is machined so that it has the aforementioned reference radial dimension d1'. If its actual radial dimension Z1 is greater than this reference value d1', the annular wall is machined until it has this reference value. If, however, its radial dimension Z1 is smaller than this reference value d1', the first repair step I cannot be performed and it is necessary to repair the nozzle as if it were a second repair II. During the second repair II, the annular wall of the nozzle is machined so that it has the radial dimension d1". During the third repair III, the plate P is machined so that it has the aforementioned reference radial dimension d1'.

The invention claimed is:

1. Method for producing a turbine-engine component, this component comprising an annular wall for supporting an abradable ring, the method comprising a step of fixing the abradable ring to the annular wall by brazing, wherein the abradable ring has finished dimensions, the method not having a step of grinding the ring after fixing thereof to the annular wall.

2. Method for repairing a turbine-engine component, said component comprising an annular wall supporting an abradable ring, the method comprising first-repair steps consisting of:

a) removing a first abradable ring, the brazing for fixing the ring to the annular wall, and an inner peripheral part of the annular wall, and b) fixing a second abradable ring to the annular wall by brazing, wherein the second abradable ring has the finished dimensions, the first repair not having a step of grinding of the second ring after fixing thereof to the annular wall.

3. Method according to claim 2, wherein step a) is carried out by machining.

4. Method according to claim 3, wherein an inner peripheral part of the annular wall is removed at step a) until the annular wall has a predetermined radial dimension.

5. Method according to claim 2, wherein it comprises second-repair steps consisting in:

c) removing the second abradable ring, the brazing for fixing this second ring, and an inner peripheral part of the annular wall, d) fixing a plate to the inner periphery of the annular wall by brazing, and e) fixing a third abradable ring with finished dimensions to the plate by brazing, the third abradable ring having a radial thickness that is different from that of the second ring and is determined according to the thickness of the plate and the thickness of material removed from the annular wall.

6. Method according to claim 5, wherein the plate is a metal sheet, which has for example a thickness of 1 mm.

7. Method according to claim 5, wherein the plate and the third ring are brazed at the same time.

8. Method according to claim 5, wherein it comprises third-repair steps consisting in:

f) removing the third abradable ring, the brazing for fixing this third ring, and an inner peripheral part of the plate, and g) fixing a fourth abradable ring with finished dimensions to the plate.

9. Method according to claim 8, wherein the plate has a predetermined radial dimension at the end of step f), and in that the fourth ring has a radial thickness identical to that of the second ring.

10. Method according to claim 2, wherein it comprises a step of marking the nozzle after the or each repair.

11. Turbine-engine component comprising an annular wall supporting an abradable ring, wherein the turbine-engine component comprises at least one marking for identifying one or more repairs to the component by replacement of the ring.

12. Component according to claim 11, wherein the abradable ring is fixed by brazing to a plate that is itself fixed by brazing to the annular wall.

13. Component according to claim 11, wherein the component is a turbine nozzle or a stator annulus.

* * * * *